US008056261B2

(12) United States Patent
Nakano et al.

(10) Patent No.: US 8,056,261 B2
(45) Date of Patent: Nov. 15, 2011

(54) FOOTWEAR SOLE CONSTRUCTION

(75) Inventors: Kiyotaka Nakano, Rockford, MI (US); Karl A. Reed, Sand Lake, MI (US); John M. Slattery, Kentwood, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 1080 days.

(21) Appl. No.: 11/780,509

(22) Filed: Jul. 20, 2007

(65) Prior Publication Data

US 2009/0019729 A1 Jan. 22, 2009

(51) Int. Cl.
*A43B 21/32* (2006.01)
*A43B 13/18* (2006.01)

(52) U.S. Cl. ..... 36/28; 36/37; 36/35 R; 36/27

(58) Field of Classification Search ..... 36/91, 92, 36/28, 27, 34 R, 35 R, 36 R, 36 A, 42, 15, 36/37, 107, 108, 103, 173
See application file for complete search history.

(56) References Cited

U.S. PATENT DOCUMENTS

| | | | | |
|---|---|---|---|---|
| 607,086 | A * | 7/1898 | Safford | 36/37 |
| 1,172,613 | A * | 2/1916 | Larsen | 36/37 |
| 1,332,070 | A * | 2/1920 | Shamo | 36/37 |
| 2,532,742 | A | 12/1950 | Stoiner | |
| 4,423,735 | A | 1/1984 | Comparetto | |
| 4,571,857 | A | 2/1986 | Castellanos | |
| 4,638,575 | A * | 1/1987 | Illustrato | 36/38 |
| 5,138,776 | A | 8/1992 | Levin | |
| 5,175,946 | A | 1/1993 | Tsai | |
| 5,187,883 | A * | 2/1993 | Penney | 36/35 R |
| 5,220,737 | A | 6/1993 | Edington | |
| 5,224,280 | A * | 7/1993 | Preman et al. | 36/30 R |
| 5,649,374 | A | 7/1997 | Chou | |
| 5,718,063 | A | 2/1998 | Yamashita et al. | |
| 5,729,917 | A | 3/1998 | Slepian et al. | |

(Continued)

FOREIGN PATENT DOCUMENTS

| | | |
|---|---|---|
| EP | 0500247 | 2/1992 |

(Continued)

OTHER PUBLICATIONS

English translation of Abstract of JP09182603.

*Primary Examiner* — Mickey Yu
*Assistant Examiner* — Chun Cheung
(74) *Attorney, Agent, or Firm* — Warner Norcross & Judd LLP

(57) ABSTRACT

A sole construction having a heel carrier and an upwardly-arched heel pad. The heel pad is fitted into and supported by the heel carrier so that the heel pad provides a spring-like bending reaction to a load. The sole construction may further include a support element disposed above the heel pad and fitted into heel carrier. The support element may be upwardly-arching so that, like the heel pad, it provides spring-like bending reaction in response to a load. The support element and heel pad may be integrally formed, for example, by molding the heel pad directly onto the support element. The heel pad and/or support element may be fitted into slots in the lateral and medial sidewalls of the heel carrier to interconnect the heel pad, support element and heel carrier. The support element may have a forward extension to function as a shank.

22 Claims, 10 Drawing Sheets

U.S. PATENT DOCUMENTS

| | | | | |
|---|---|---|---|---|
| 5,815,950 | A | | 10/1998 | Wang |
| 5,881,478 | A | | 3/1999 | McMahon et al. |
| 5,918,384 | A | | 7/1999 | Meschan |
| 5,933,983 | A | | 8/1999 | Jeon |
| 5,937,545 | A | | 8/1999 | Dyer et al. |
| 5,970,628 | A | * | 10/1999 | Meschan ..... 36/42 |
| 6,122,844 | A | | 9/2000 | Nunez |
| RE37,705 | E | | 5/2002 | Donzis |
| 6,457,262 | B1 | | 10/2002 | Swigart |
| 6,470,599 | B1 | | 10/2002 | Chu |
| 6,662,471 | B2 | | 12/2003 | Meschan |
| 6,665,958 | B2 | | 12/2003 | Goodwin |
| D509,951 | S | | 9/2005 | Johnson |
| 6,944,973 | B2 | | 9/2005 | Goodwin |
| 6,971,193 | B1 | | 12/2005 | Potter et al. |
| 7,020,988 | B1 | | 4/2006 | Holden et al. |
| 7,043,857 | B2 | | 5/2006 | Meschan |
| 7,114,269 | B2 | | 10/2006 | Meschan |
| 7,140,124 | B2 | | 11/2006 | Manz et al. |
| 7,155,843 | B2 | | 1/2007 | Meschan |
| 2004/0250449 | A1 | | 12/2004 | Testa et al. |
| 2006/0032089 | A1 | | 2/2006 | Lo |
| 2006/0086003 | A1 | | 4/2006 | Tseng |
| 2006/0117602 | A1 | | 6/2006 | Meschan et al. |
| 2006/0156581 | A1 | | 7/2006 | Holden et al. |
| 2006/0254086 | A1 | | 11/2006 | Meschan et al. |
| 2006/0283047 | A1 | | 12/2006 | Schoenborn et al. |
| 2007/0017122 | A1 | | 1/2007 | Feller et al. |
| 2007/0022631 | A1 | | 2/2007 | Ho |
| 2007/0028484 | A1 | | 2/2007 | Akhidime |

FOREIGN PATENT DOCUMENTS

| | | |
|---|---|---|
| JP | 09182603 | 7/2007 |
| WO | 9115973 | 10/1991 |

* cited by examiner

FOOTWEAR SOLE CONSTRUCTION

BACKGROUND OF THE INVENTION

The present invention relates to footwear and more particularly to a sole construction for an article of footwear.

The primary functional purposes of footwear are to protect and support the wearer's foot. Most of the support and protection afforded by an article of footwear is attributable to the design and configuration of the sole. The sole protects the foot in part by dispersing the force of sharp and pointed objects, such as rocks and sticks. The sole also provides cushioning that absorbs impact and protects the wearer (e.g. feet, ankles and knees) from the associated stress. As the same time, the foot has a natural shape and the sole plays a role in helping to support the foot in its proper shape to reduce the risk of the foot becoming fatigued over time.

The objectives of providing comfortable cushioning and firm support are often at odds. Accordingly, there is an ongoing interest in developing footwear sole constructions that provide an appropriate balance between support and cushioning. An overly soft sole may not provide sufficient foot support and may lead to premature foot fatigue. On the other hand, an overly stiff sole may lead to a different set of problems. For example, an overly firm sole may feel uncomfortable and may not provide the cushioning needed to protect the wearer against the damage associated with repeated ground impact.

SUMMARY OF THE INVENTION

The present invention provides a sole construction having a heel carrier and a heel pad that is fitted into a heel carrier in an upwardly bowed configuration. The heel pad is manufactured from a material that is sufficiently yielding to allow the heel pad to bend in a spring-like manner in response to typically loads. In one embodiment, the heel carrier is interfitted with the outsole. The heel carrier may include arms that extend into openings in the sidewalls of the outsole so that the carrier is firmly held in place and visible from the exterior of the sole.

In one embodiment, the sole construction also includes a support element that is disposed above the heel pad. The support element may be closely fitted into the carrier so that it assists in maintaining the heel pad in the correct position with respect to the carrier. The support element is interfitted with or otherwise secured to the heel pad. In one embodiment, the support element follows a curve similar to the curve of the heel pad. In this embodiment, the support element bends in a spring-like manner under load in much the same way as the heel pad. In one embodiment, the heel pad is molded directly onto the support element such that the two elements form a single unitary construction. In one embodiment, the support element defines a central opening that exposes the underlying heel pad.

In one embodiment, the support element includes a forward extension that extends into the arch region to function as a shank. In one embodiment, the support element includes a rear extension that may assist in providing longitudinal alignment of the support element and may also provide supplemental heel support.

In one embodiment, the support element is generally "+"-shaped having lateral and medial extensions that are interfitted with the heel carrier, as well as a forward extension and a rear extension. The support element may be oversized in the lateral direction so that it is fitted into the carrier under tension in a bowed configuration in generally the same manner as the heel pad. In this embodiment, the support element and the heel pad cooperatively function as spring-like elements.

The present invention provides an effective and durable sole construction that provides graduated cushioning through a broad range of loads. The heel pad and support element may bend in a spring-like manner to absorb loads. Once the heel pad and support element have bent to a point where they bottom-out in the heel carrier, the components compress under further load, thereby providing a graduated response to loads. The support element may be used to provide supplemental cushioning and to maintain the heel pad in proper alignment with the heel carrier. When present, the central opening in the support element provides a soft region that helps to center the heel. The cushioning characteristics of the sole construction can be easily tuned through variations in the shape and materials of the sole construction components.

These and other objects, advantages, and features of the invention will be readily understood and appreciated by reference to the detailed description of the current embodiment and the drawings.

DESCRIPTION OF THE CURRENT EMBODIMENT

Figure 1:
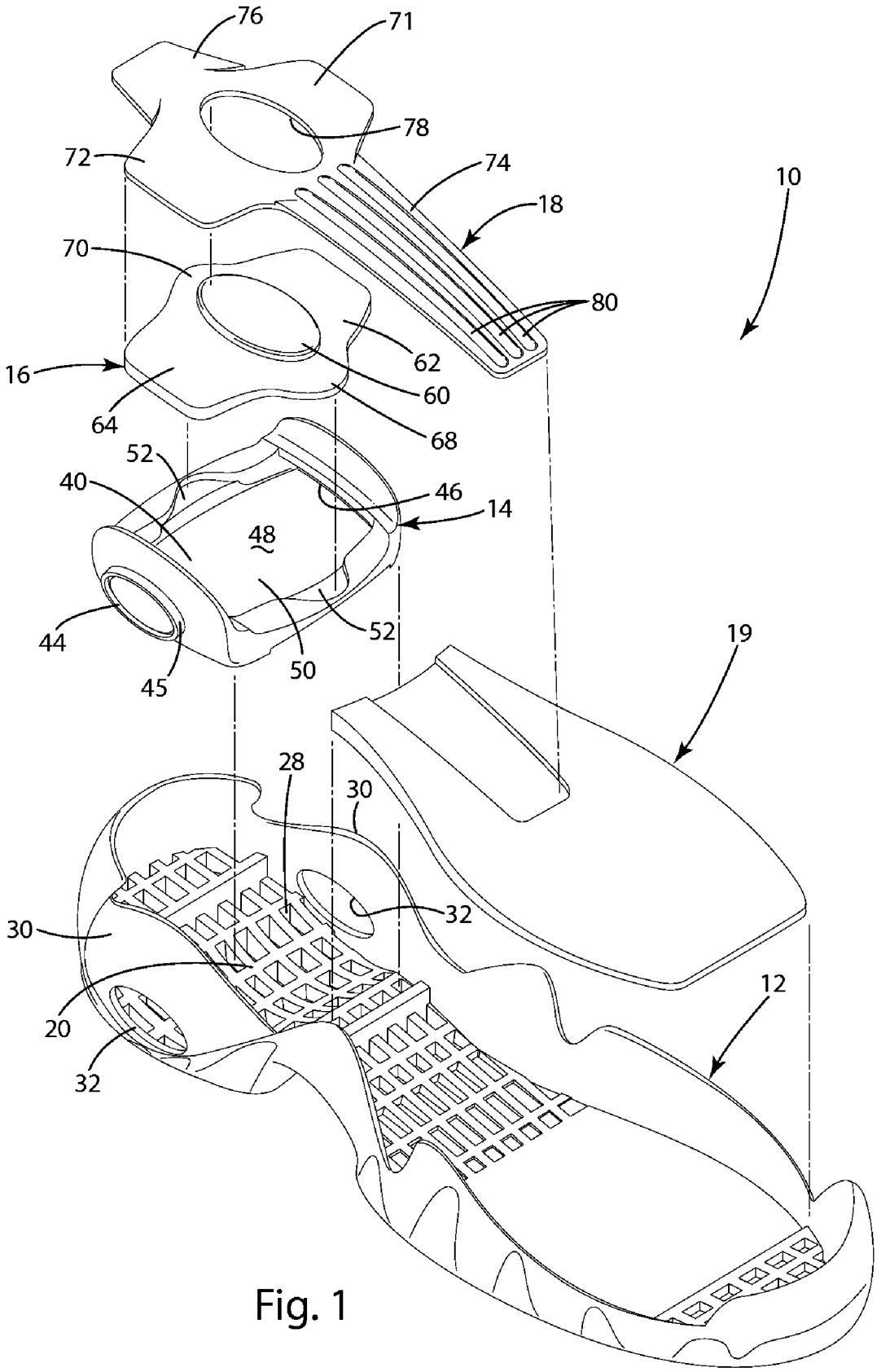
FIG. 1 is an exploded perspective view of a sole construction in accordance with an embodiment of the invention.

A sole construction manufactured in accordance with an embodiment of the present invention is shown in FIG. 1 and generally designated 10. In the illustrated embodiment, the sole construction 10 generally includes an outsole 12, a heel carrier 14, a heel pad 16 and a support element 18. The heel carrier 14 is interfitted with the outsole 12 and provides a cradle for the heel pad 16 and the support element 18. The heel pad 16 is fitted into the carrier 14 and is held by the carrier 14 in an upwardly bowed configuration. Accordingly, the heel pad 16 responds to heel load in part by flexing downwardly in a spring-like manner. The support element 18 overlies the heel pad 16 and, like the heel pad 16, may be fitted into the carrier 14 in an upwardly bowed configuration so that the support element 18 and heel pad 16 form a cooperative spring-like response to heel loads.

Figure 2:
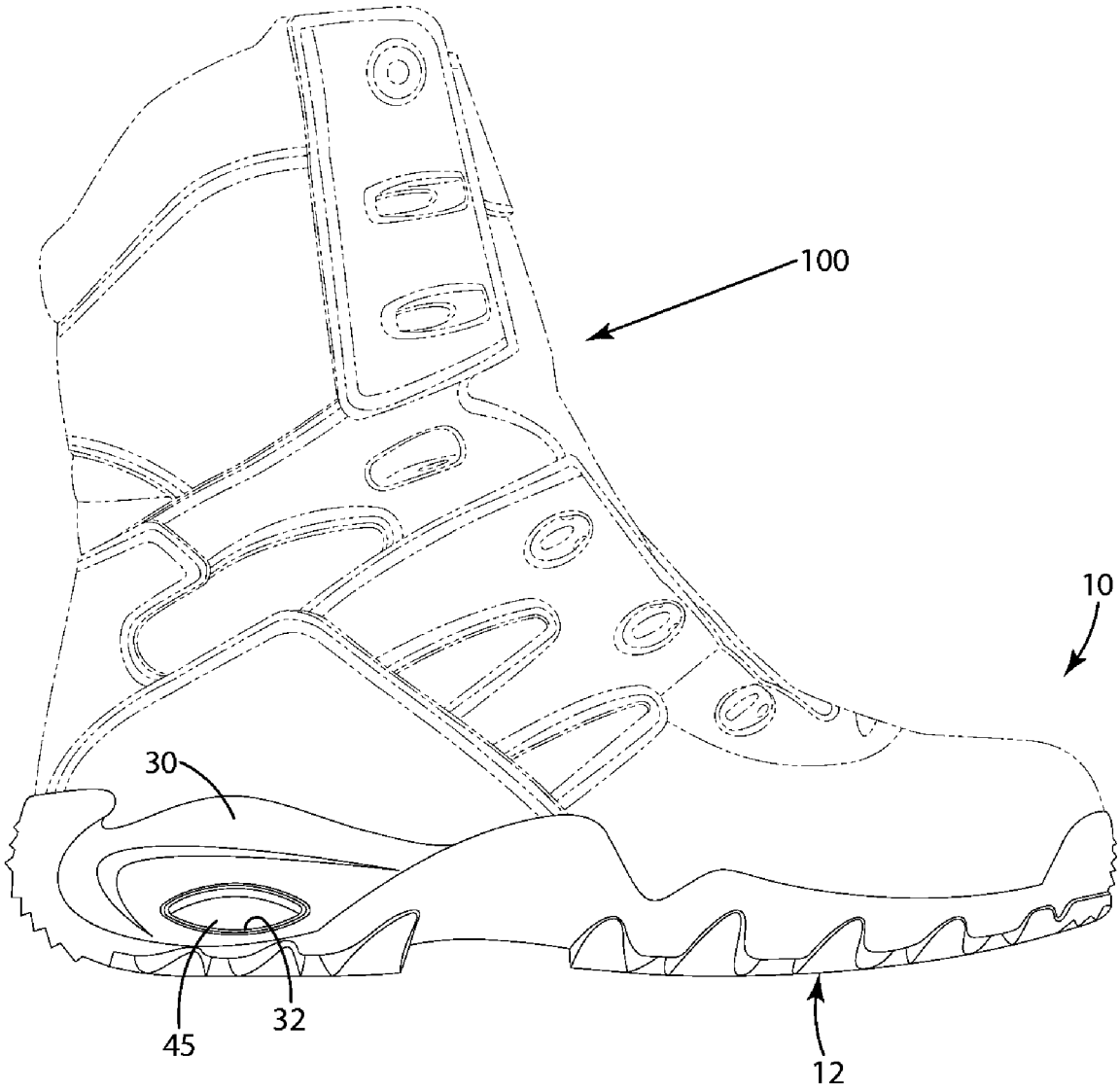
FIG. 2 is a side elevational view of the sole construction.
Figure 3:
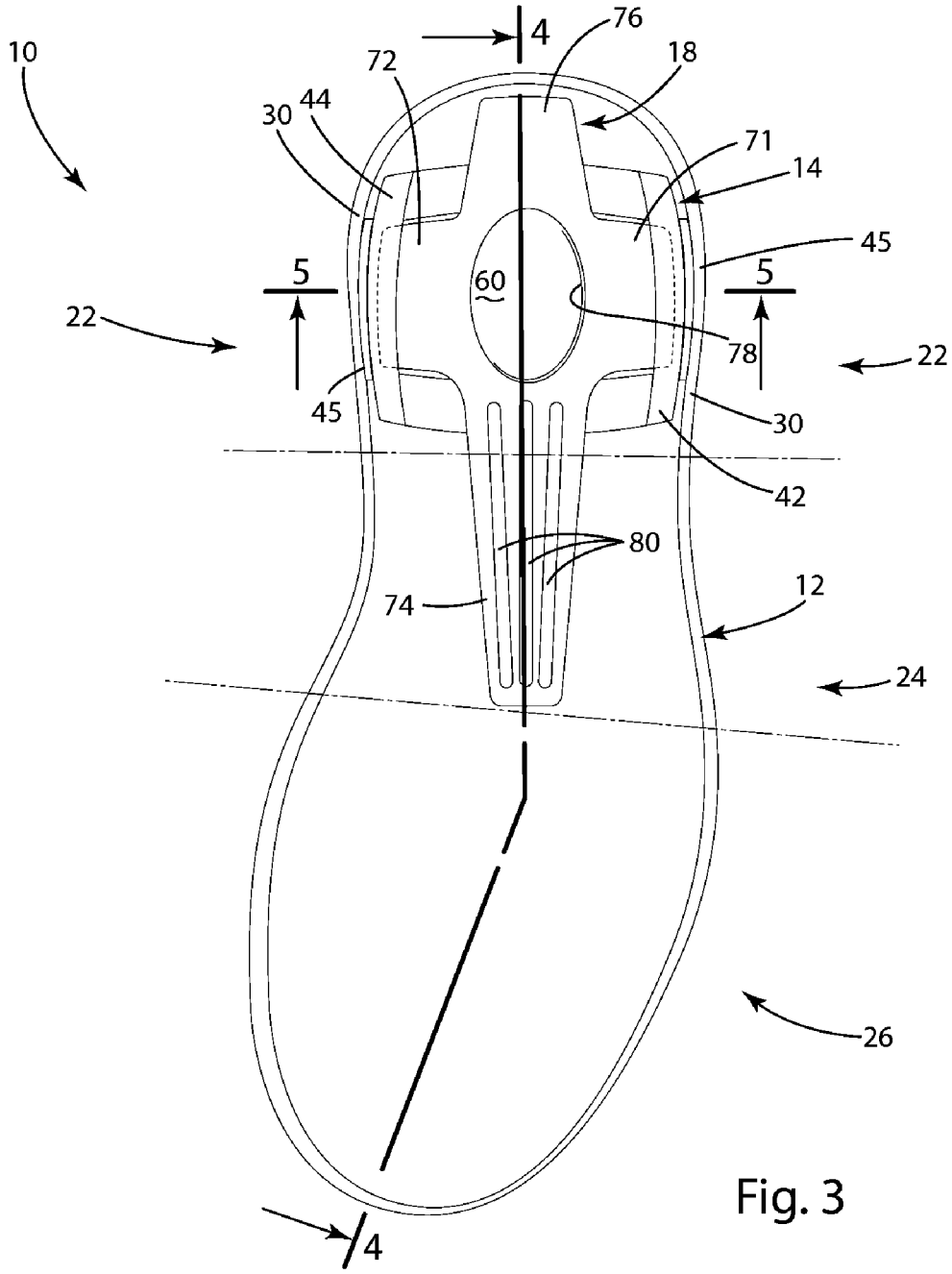
FIG. 3 is a top plan view of the sole construction.
Figure 4:
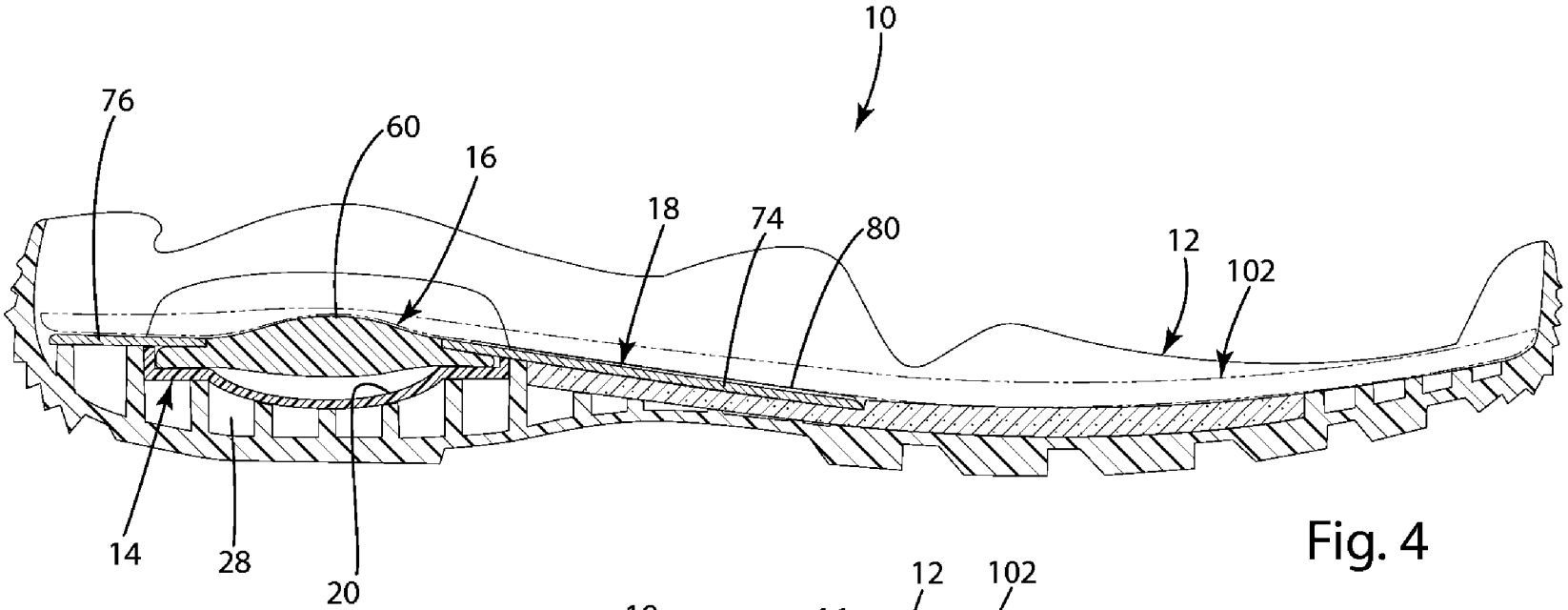
FIG. 4 is a sectional view of the sole construction taken along line IV-IV of FIG. 3.
Figure 5:
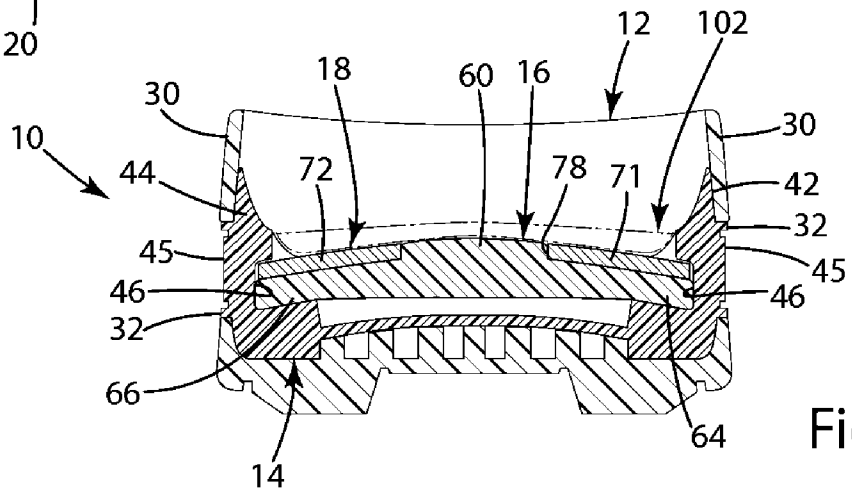
FIG. 5 is a sectional view of the sole construction taken along line V-V of FIG. 3.
Figure 6:
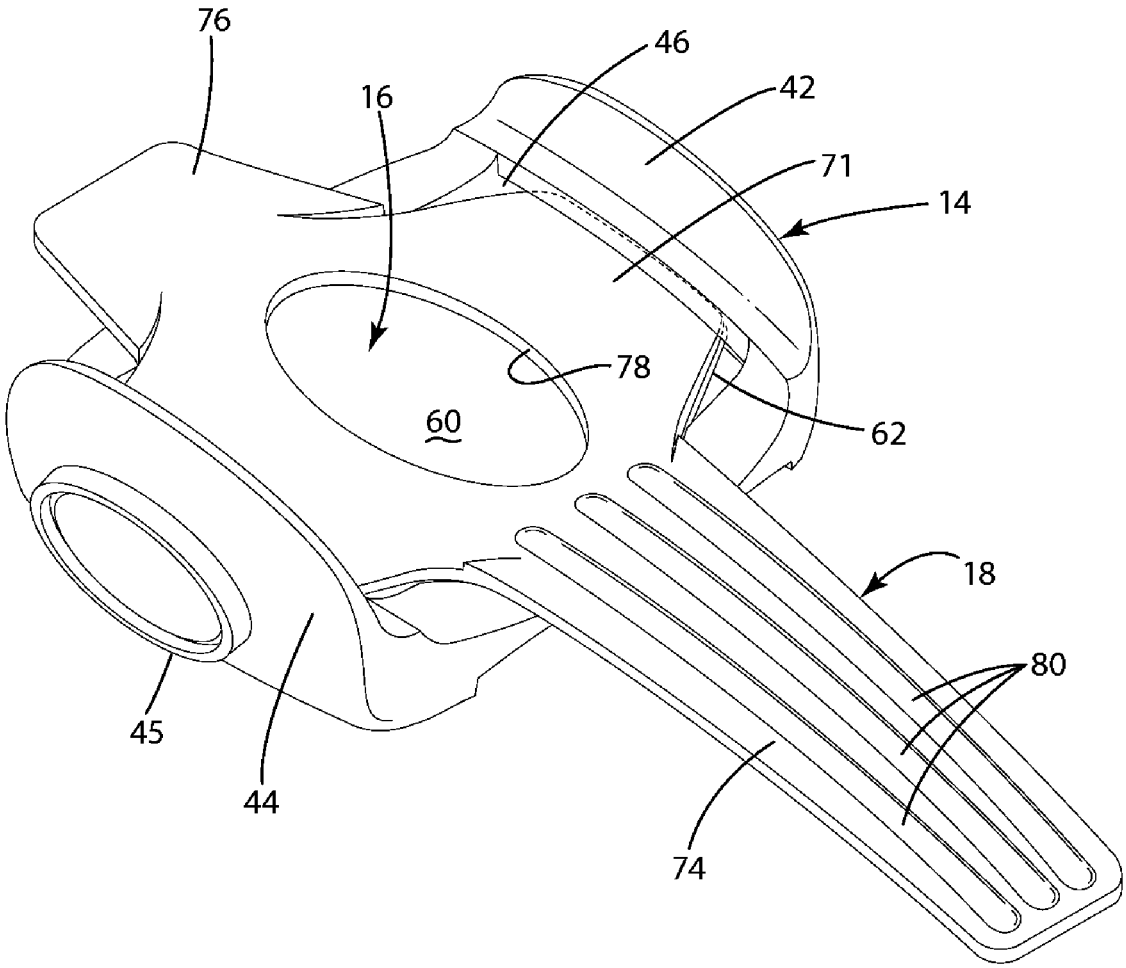
FIG. 6 is a perspective view of the assembled heel carrier, heel pad and support element.
Figure 7A:
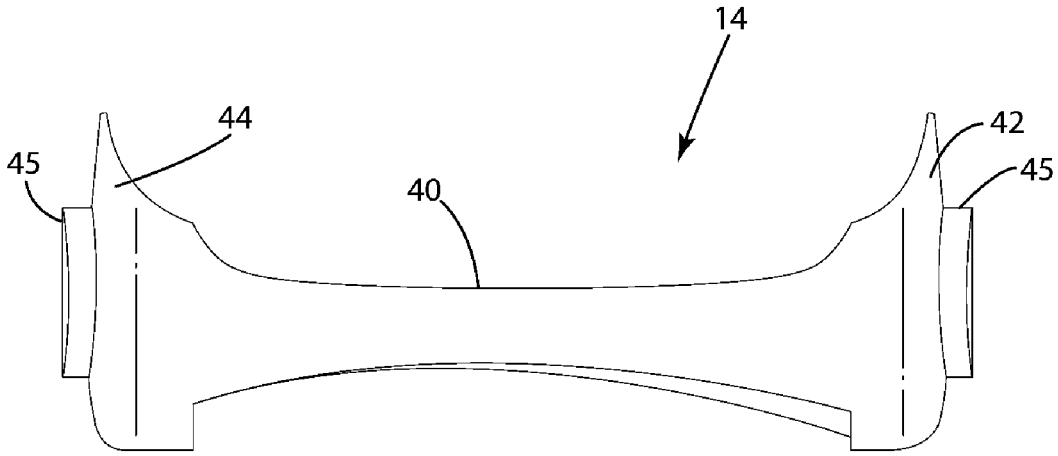
FIG. 7A is a front elevational view of the heel carrier.
Figure 7B:
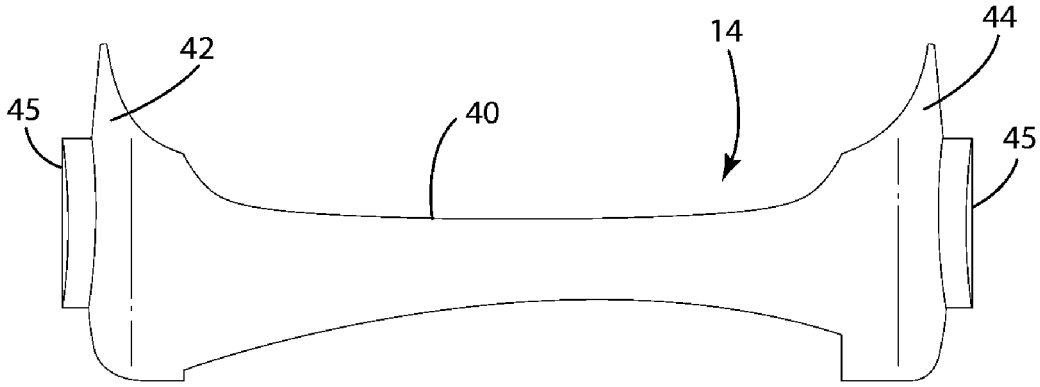
FIG. 7B is a rear elevational view of the heel carrier.
Figure 8:
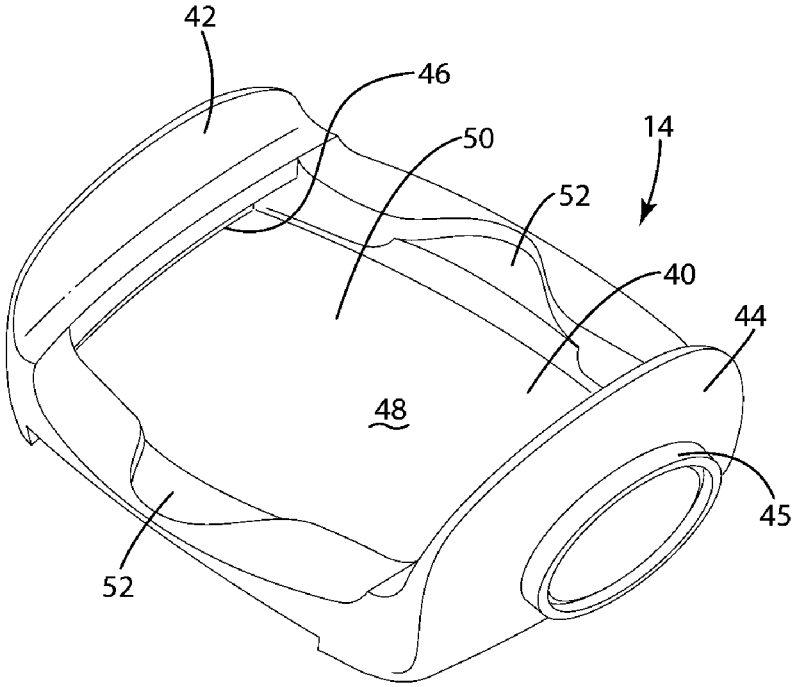
FIG. 8 is a perspective view of the heel carrier.
Figure 9:
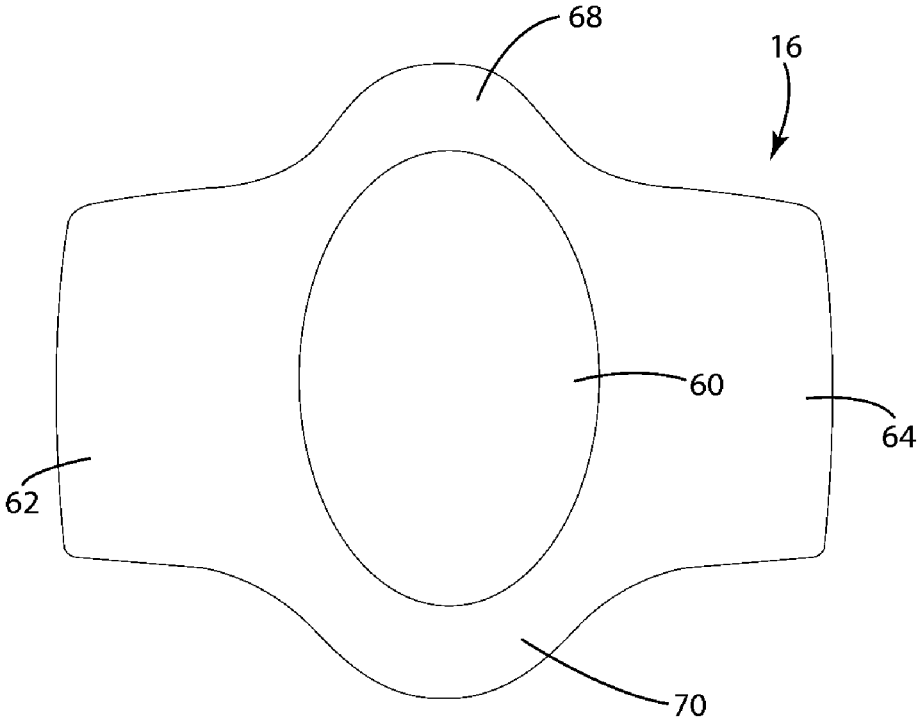
FIG. 9 is a top plan view of the heel pad.
Figure 10:
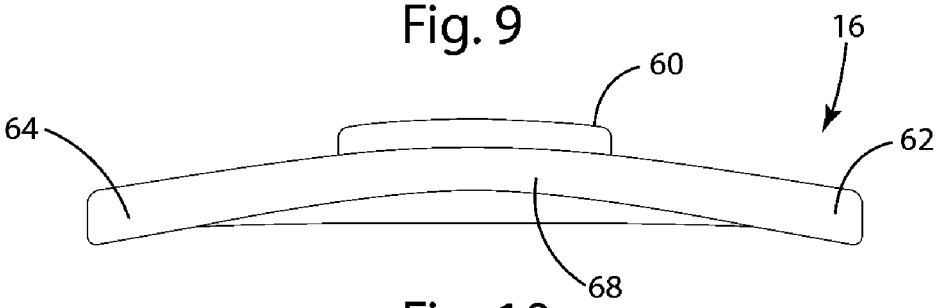
FIG. 10 is a front elevational view of the heel pad.
Figure 11:
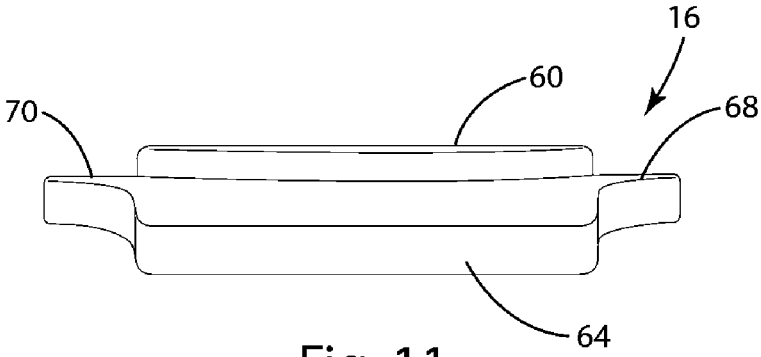
FIG. 11 is a side elevational view of the heel pad.
Figure 12:
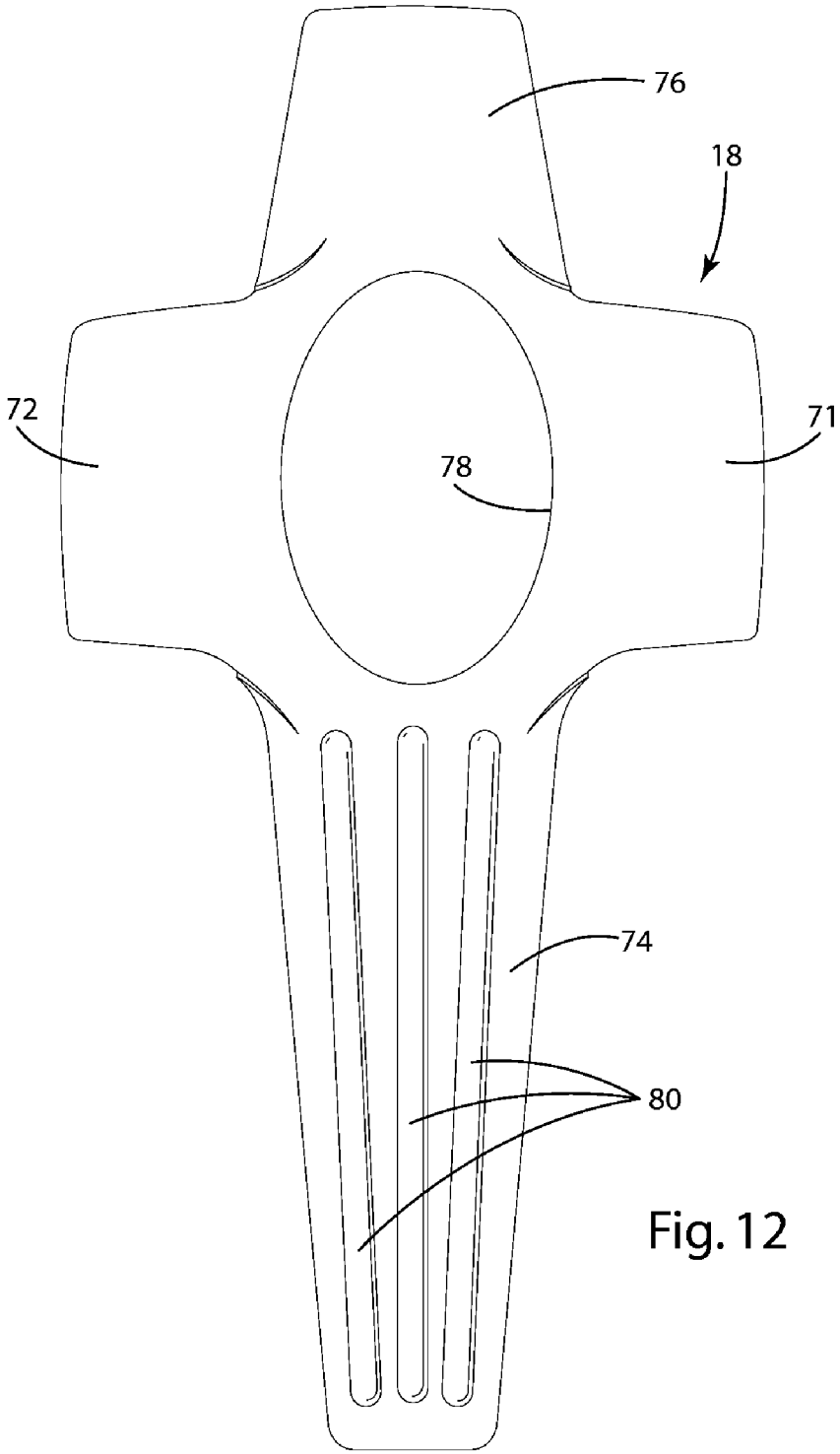
FIG. 12 is a top plan view of the support element.
Figure 13:
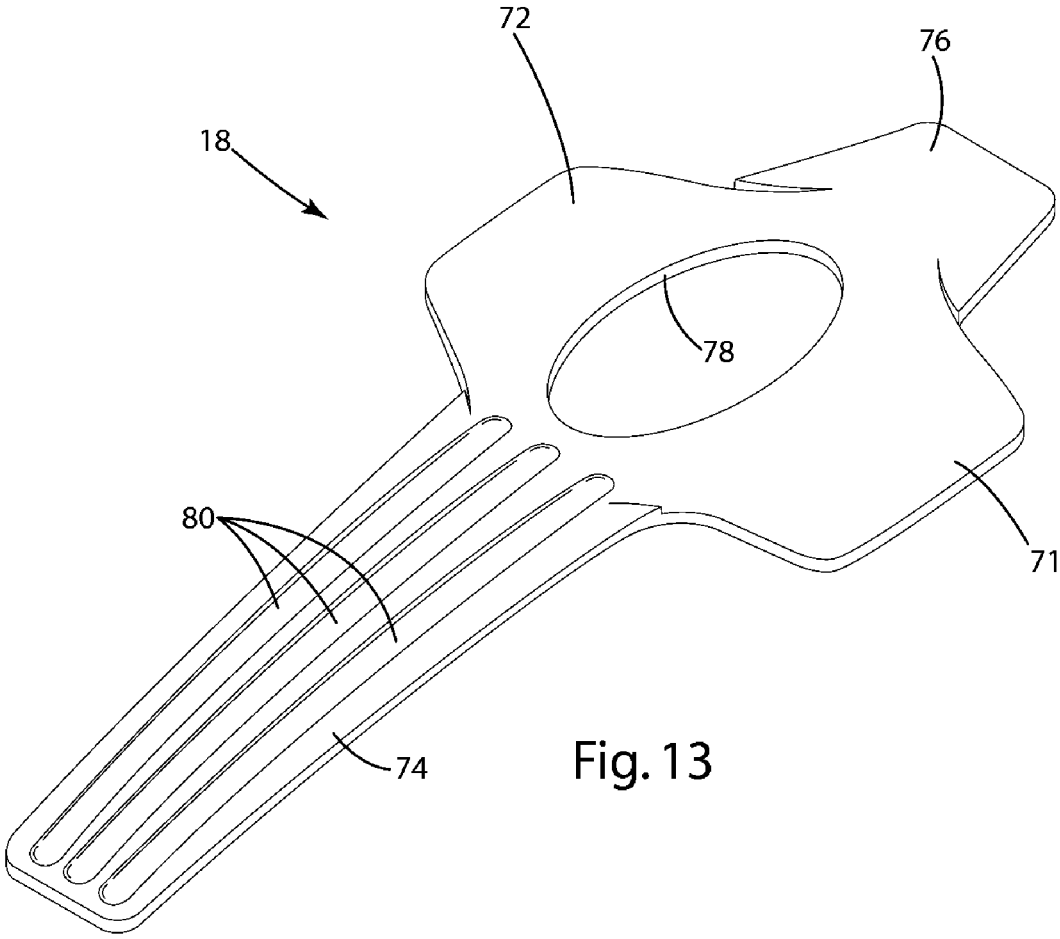
FIG. 13 is a perspective view of the support element.

The sole construction of the present invention may be incorporated into essentially any type of footwear, such as boots, shoes and sandals. The sole construction may be secured to essentially any upper to form an article of footwear, such as the boot upper 100 shown in phantom lines in FIG. 2. Although not described in detail herein, the sole construction can be joined to an upper using essentially any methods and apparatus that form a suitably durable connection. For example, the sole construction may be cemented or otherwise adhesively secured to the upper. As another example, the sole construction may be incorporated into a welted construction. Further, the present invention is not limited to specific sole components shown in the drawings. To the contrary, the sole construction may be used with essentially any additional sole components, such as an insole, sock liner, midsole, heel wedge or other supplemental support, comfort or cushioning components. For example, an insole 102 is shown in FIGS. 4 and 5 in phantom lines.

In the illustrated embodiment, the outsole 12 is a molded outsole that is specially shaped to receive the heel carrier 14. The outsole 12 includes a heel area 22, an arch area 24 and a forefoot area 26, which roughly correspond to the areas underlying the identified portions of the wearer's foot. The illustrated outsole 12 includes a waffled region 28 in the heel area 22. The waffled region 28 has less weight than a solid heel and includes an arrangement of intersecting walls that cooperate to provide the desired structural support. The upper surface of the waffled region 28 may be shaped to define a concave seat 20 for the heel carrier 14. The outsole 12 may also include vertical sidewalls 30 on both the lateral and medial sides of the heel area 22. In the illustrated embodiment, the sidewalls 30 define openings 32 that receive lateral and medial plugs 45 of the heel carrier 14, as described in more detail below. The openings 32 may extend entirely through the sidewalls 30 so that the heel carrier 14 is visible from outside the outsole 12. The outsole 12 may also include a recess configured to receive forefoot cushion 19. The forefoot cushion 19 may be manufactured from essentially any material providing suitable cushioning characteristics, such as EVA or PU.

The present invention is described in connection with an exemplary outsole 12. The present invention is readily incorporated into essentially any outsole capable of directly or indirectly supporting the heel carrier 14, the heel pad 16 and the support element 18. For example, the outsole need not be injection molded and need not include waffled-regions in the heel.

As noted above, the heel carrier 14 is a relatively inflexible component that receives the heel pad 16 and optionally the support element 18. The heel carrier 14 is generally cup-shaped defining a heel pad cradle 40 configured to receive the heel pad 16. The cradle 40 holds the heel pad 16 in an upwardly bowed or arched orientation along the lateral direction (i.e. in a lateral to medial direction). If desired, the cradle 40 may hold the heel pad 16 in upwardly bowed configuration in other or additional directions. The cradle 40 may also hold the support element 18 in an upwardly bowed or arched configuration. The illustrated cradle 40 includes a lateral sidewall 42 and a medial sidewall 44. As shown, the lateral and medial sidewalls 42 and 44 may each include an exterior plug 45 that is configured to be interfitted with a corresponding opening 32 in the outsole 12. The lateral and medial sidewalls 42 and 44 may also define internal channels or slots 46 configured to receive the lateral and medial ends of the heel pad 16 and/or the support element 18. The slots 46 may be dimensioned to closely receive the heel pad 16 and/or the support element 18 to assist in retaining the components in the heel carrier 14. The cradle 40 also includes a top surface 48 that is shaped to permit bending deformation of the heel pad 16 and the support element 18. For example, the top surface 48 may include a relatively deep central region 50 and a pair of contoured shoulders 52. The central region 50 of the illustrated embodiment follows a concave line in the longitudinal direction and a convex line in the lateral direction. However, the contours of the central region 50 may vary from application to application as desired. For example, the central region 50 may be concave in both the lateral and longitudinal directions or it may be planar in one or both directions. The heel carrier 14 may be manufactured using any suitable materials and manufacturing techniques. For example, the heel carrier 14 may be a single unitary construction that is injection molded from TPR having a durometer value of approximately 90 on the Asker A scale. If desired, the heel carrier 14 (or portions of the heel carrier 14) may be manufactured from a transparent or translucent material that provides full or partially visibility of the heel pad 16 and the support element 18 disposed within. For example, the heel carrier 14 may be transparent or translucent in the region of plugs 45 so that the components in the interior of the heel carrier 14 are visible through the plugs 45. In applications where the plugs 45 are visible from the exterior of the outsole 12, the internal components will be visible from the exterior of the shoe.

In the illustrated embodiment, the heel carrier 14 is interfitted with the outsole 12. The heel carrier 14 may alternatively be interfitted or otherwise intersecured with other sole components. For example, the heel carrier 14 may be interfitted with a midsole, a heel wedge or other cushioning, support or comfort layer of the sole. Additionally, the present invention is illustrated in connection with an assembly intended to be fitted into the heel area of the sole. The present invention may alternatively be incorporated into other or additional areas of the sole. For example, a carrier, pad and support element in accordance with the present invention may alternatively or additionally be installed in the forefoot area of the sole.

As noted above, the heel pad 16 of the illustrated embodiment is fitted into the carrier 14 in a bowed or arched condition. As shown, the illustrated heel pad 16 curves upwardly in its center toward the wearer's heel. In use, the arched heel pad 16 provides a bending, spring-like response to initial heel load, such as the loads encountered during walking and running. Under heavy loads, the heel pad 16 may bottom-out against the top surface of the heel carrier 14 at which time the heel pad 16 and other sole components may undergo compression to cooperatively provide a graduated response to continued loading. In the illustrated embodiment, the heel pad 16 is manufactured with the desired bowed or arched shape. Alternatively, the heel pad 16 may be manufactured with less of an arched shape (possibly even flat) so that the support heel pad 16 undergoes some deformation when fitted into the cradle 40. In the illustrated embodiment, the heel pad 16 includes a central body 60 surrounded by a skirt 62. The central body 60 may be a bulbous region of material configured to provide the desired cushioning characteristics once the heel pad 16 has bottomed-out against the carrier 14 under a load. The skirt 62 may include a lateral arm 64 and a medial arm 66 that are interfitted with slots 46. The skirt 62 may also include a forward lip 68 and a rear lip 70 that interfit with the shoulders 52 in the carrier 14. The lips 68 and 70 may be interfitted with the shoulders 52 in an unloaded state or they may only become interfitted with the shoulders 52 once the heel pad 16 deforms under a load. The heel pad 16 may be manufactured using any suitable materials and manufacturing techniques. For example, the heel pad 16 may be injection molded from TPR having a durometer value of approximately 30 on the Asker A scale. The heel pad 16 could be manufactured from EVA, PU or other suitable cushioning materials.

The support element 18 overlies the heel pad 16 and is interfitted with the carrier 14. In the illustrated embodiment, the support element 18 helps to position and support the heel pad 16. The illustrated support element 18 is generally "+"- shaped having a lateral extension 71, a medial extension 72, a forward extension 74 and a rear extension 76. The support element 18 may also define a central opening 78 that receives a portion of the central body 60 of the heel pad 16. As shown, the central opening 78 may be somewhat elliptical in cross section to provide a relatively soft central region of exposed heel pad 16 material that helps to center the wearer's heel during use. In the illustrated embodiment, the support element 18 is manufactured with an arched shape that permits the support element 18 (in an undeformed state) to fit into the slots 46 in the cradle 40 while simultaneously following the bowed shape of the flexed heel pad 16. Alternatively, the support element 18 may be manufactured with less of an arched shape (possibly even flat) so that the support element 18 undergoes some deformation when fitted into the cradle 46. In the illustrated embodiment, the lateral extension 71 and medial extension 72 extend in opposite directions to engage the slots 46 on opposite sides of the carrier 14. The size, shape, material and other properties of the lateral and medial extensions 71 and 72 may be varied from application to application to provide the desired support and cushioning characteristics. In the illustrated embodiment, the forward extension 74 extends forwardly into the arch area 24 to function as a shank. The forward extension 74 may include a plurality of longitudinally extending ridges 80 that strengthen the forward extension 74 in the longitudinal direction. If included, the number, arrangement and size of ridges 80 may vary from application to application. As with the lateral and medial extensions, the size, shape, material and other properties of the lateral extension 71 may vary from application to application to provide the desired support characteristics. The rear extension 76 extends rearwardly toward the heel end of the sole construction 10. The rear extension may be configured to assist in centering the support element 18 and to provide additional support. The size, shape, material and other properties of the lateral extension 71 may vary from application to application to provide the desired support characteristics. In the illustrated embodiment, the support element 18 is a one-piece structure having integral lateral, medial, forward and rear extensions. The support element 18 may alternatively be an assembly of separately manufactured elements.

In the illustrated embodiment, the heel pad 16 and the support element 18 are separately manufactured and installed in the heel carrier 14 as separate elements. As shown, opposite ends of the heel pad 16 and the support element 18 of the illustrated embodiment are fitted into the slots 46 in the heel carrier 14. Alternatively, the heel pad 16 and the support element 18 may be intersecured prior to installation in the heel carrier 14. For example, the heel pad 16 may be directly molded onto the support element 18. This may be done by placing the support element 18 into the heel pad mold (not shown) and injected the heel pad material into the mold so that it cures in direct contact with the support element 18. As other examples of an intersecured embodiment, the heel pad 16 may be frictionally interfitted with the support element 18 or the heel pad 16 may be cemented or otherwise adhesively secured to the support element 18 before installation in the carrier 14.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. An assembly for a footwear sole comprising:

a relatively inflexible carrier defining a lateral slot and a medial slot and having an upper surface and a lower surface, said upper surface defining a pad cradle;

a pad fitted into said cradle of said carrier, said pad being bowed upwardly in the center away from said upper surface of said carrier, said pad having a lower surface spaced apart from said upper surface of said carrier to define a void whereby said pad undergoes a spring-like bending into said void in response to downward forces; and a support element disposed above said pad and fitted into said cradle, said support element defining an opening to receive a portion of said pad and being bowed upwardly in the center away from said upper surface of said carrier, whereby said support element provides a spring-like bending response to downward forces, said carrier supporting said pad and said support element over said void, wherein said support element includes a medial extension and a lateral extension, said lateral extension fitted into said lateral slot and said medial extension fitted into said medial slot.

2. The assembly of claim 1 wherein said carrier is further defined as a heel carrier and said pad is further defined as a heel pad.

3. The assembly of claim 2 wherein said support element is intersecured with said heel pad by frictionally interfitting said portion of said heel pad with said support element opening.

4. The assembly of claim 2 wherein said support element includes a forward extension to function as a shank.

5. The assembly of claim 2 wherein said heel pad includes a lateral end fitted into said lateral slot and a medial end fitted into said medial slot.

6. The assembly of claim 2 wherein said support element includes a forward extension, a rear extension, a lateral extension and a medial extension.

7. The assembly of claim 2 wherein said support element and said heel pad are integrally molded to one another.

8. The assembly of claim 2 further including a sole component defining a lateral opening and a medial opening, opposite sides of said heel carrier being fitted into said lateral opening and said medial opening.

9. The assembly of claim 8 wherein said sole component is an outsole.

10. The assembly of claim 9 wherein at least one of said lateral opening and said medial opening is a through-hole, whereby said heel carrier is visible from an exterior of said sole component.

11. The assembly of claim 10 wherein said heel carrier is manufactured from a transparent or translucent material that provides at least visibility into said heel carrier for an exterior of said sole component.

12. An assembly for a footwear sole comprising:

a sole component;

a heel carrier interfitted with said sole component, said heel carrier having a lateral slot, a medial slot, an upper surface and a lower surface, said upper surface defining a heel pad cradle;

a pad fitted into said cradle of said carrier, said pad being bowed upwardly in the center away from said upper surface of said carrier and spaced apart from said sole component to define a void therebetween, whereby said pad provides a spring-like bending into said void in response to downward forces; and a support element disposed above said pad and defining an opening intersecured with said pad, wherein said support element includes a medial extension and a lateral extension, said lateral extension fitted into said lateral slot and said medial extension fitted into said medial slot.

13. The assembly of claim 12 wherein said support element is bowed upwardly in the center away from said upper surface of said heel carrier, whereby said support element provides a spring-like bending response to downward forces.

14. A sole construction for an article of footwear comprising:

a sole component having a seat;

a heel carrier disposed in said seat, said heel carrier defining a heel pad cradle, a lateral slot and a medial slot;

a heel pad fitted into said cradle of said heel carrier, said heel pad being bowed upwardly toward a center of said heel pad, whereby said heel pad provides a bending, spring-like cushioning element, said center of said heel pad being operable to bottom-out against said heel carrier under a load, and in response to continued loading, said heel pad being operable to undergo compression to provide a cushioning response; and a support element including a medial extension and a lateral extension, said lateral extension fitted into said lateral slot and said medial extension fitted into said medial slot.

15. The sole construction of claim 14 wherein said heel pad includes a lateral end fitted into said lateral slot and a medial end fitted into said medial slot.

16. The sole construction of claim 15 wherein said support element is disposed above said heel pad and is intersecured with said heel pad.

17. The sole construction of claim 16 wherein said support element is arched upwardly in at least one dimension to provide a bending, spring-like cushioning element.

18. The sole construction of claim 17 wherein said support element includes a forward extension of sufficient length to function as a shank.

19. The sole construction of claim 16 wherein said support element includes a forward extension, a rear extension, a lateral extension and a medial extension.

20. The sole construction of claim 19 wherein said support element and said heel pad are integrally molded to one another.

21. The sole construction of claim 17 wherein said support element defines a central opening intersecured with a portion of said heel pad.

22. The assembly of claim 1 wherein the carrier is formed of a material having a durometer value of at least approximately 90.

* * * * *